US010213894B2

(12) United States Patent
Hu et al.

(10) Patent No.: US 10,213,894 B2
(45) Date of Patent: Feb. 26, 2019

(54) METHOD OF PLACING WINDOW IN THIN POLISHING PAD

(71) Applicant: Applied Materials, Inc., Santa Clara, CA (US)

(72) Inventors: Yongqi Hu, Fremont, CA (US); Kadthala Ramaya Narendrnath, San Jose, CA (US); Thomas Lawrence Terry, Hollister, CA (US)

(73) Assignee: Applied Materials, Inc., Santa Clara, CA (US)

( * ) Notice: Subject to any disclaimer, the term of this patent is extended or adjusted under 35 U.S.C. 154(b) by 188 days.

(21) Appl. No.: 15/054,849

(22) Filed: Feb. 26, 2016

(65) Prior Publication Data

US 2017/0246722 A1 Aug. 31, 2017

(51) Int. Cl.
*B24B 37/20* (2012.01)

(52) U.S. Cl.
CPC ..... *B24B 37/205* (2013.01)

(58) Field of Classification Search
CPC ..... B24B 37/205
See application file for complete search history.

(56) References Cited

U.S. PATENT DOCUMENTS 5,893,796 A * 4/1999 Birang ..... B24B 37/013 451/283
6,146,242 A 11/2000 Treur et al.
6,171,181 B1 1/2001 Roberts et al.
6,224,460 B1 5/2001 Dunton et al.
6,254,459 B1 7/2001 Bajaj et al.
6,358,130 B1 * 3/2002 Freeman ..... B24B 37/205 451/285
6,383,058 B1 5/2002 Birang et al.
6,458,014 B1 10/2002 Ishikawa et al.
6,599,765 B1 7/2003 Boyd et al.
6,685,537 B1 2/2004 Fruitman et al.
(Continued)

FOREIGN PATENT DOCUMENTS

EP 1470892 10/2004
JP 2003-62748 3/2003
(Continued)

OTHER PUBLICATIONS

International Search Report and Written Opinion in International Application No. PCT/US2016/019916, dated Nov. 18, 2016, 12 pages.

*Primary Examiner* — Marc Carlson
(74) *Attorney, Agent, or Firm* — Fish & Richardson P.C.

(57) ABSTRACT

A polishing pad includes a polishing layer stack that has a polishing surface, a bottom surface, and an aperture from the polishing surface to the bottom surface. The polishing layer stack includes a polishing layer that has the polishing surface. A fluid-impermeable layer spans the aperture and the polishing pad. A first adhesive layer of a first adhesive material is in contact with and secures the bottom surface of the polishing layer to the fluid-impermeable layer. The first adhesive layer spans the aperture and the polishing pad. The light-transmitting body is positioned in the aperture and has a lower surface in contact with, is secured to the first adhesive layer, and is spaced apart from a side-wall of the aperture by a gap. An adhesive sealant of a different second material is disposed in and laterally fills the gap.

1 Claim, 3 Drawing Sheets

(56) References Cited

U.S. PATENT DOCUMENTS

| | | | | |
|---|---|---|---|---|
| 6,806,100 | B1 | 10/2004 | Xu et al. | |
| 7,179,151 | B1 | 2/2007 | Bottema et al. | |
| 7,195,539 | B2 | 3/2007 | Turner et al. | |
| 7,323,415 | B2 | 1/2008 | Shiho et al. | |
| 7,654,885 | B2 | 2/2010 | Tsai et al. | |
| 8,393,940 | B2 | 3/2013 | Swedek et al. | |
| 8,562,389 | B2 | 10/2013 | Benvegnu et al. | |
| 2002/0137431 | A1 | 9/2002 | Labunsky et al. | |
| 2003/0109209 | A1 | 6/2003 | Hishiki | |
| 2003/0129931 | A1* | 7/2003 | Konno | B24B 37/205 451/285 |
| 2003/0153253 | A1 | 8/2003 | Hanamoto et al. | |
| 2004/0192169 | A1 | 9/2004 | Kimura et al. | |
| 2005/0060943 | A1 | 3/2005 | Turner et al. | |
| 2005/0064802 | A1* | 3/2005 | Wiswesser | B24B 37/013 451/285 |
| 2005/0191945 | A1 | 9/2005 | Petroski et al. | |
| 2005/0221723 | A1* | 10/2005 | Duboust | B24B 37/013 451/41 |
| 2006/0037699 | A1 | 2/2006 | Nakamori et al. | |
| 2006/0128271 | A1* | 6/2006 | Shiho | B24B 37/205 451/6 |
| 2006/0197249 | A1* | 9/2006 | Shih | B24B 37/205 264/46.4 |
| 2008/0305729 | A1* | 12/2008 | Benvegnu | B24B 37/013 451/530 |
| 2010/0267318 | A1* | 10/2010 | Duboust | B24B 37/013 451/533 |
| 2011/0281510 | A1* | 11/2011 | Swedek | B24B 37/013 451/527 |
| 2013/0017769 | A1 | 1/2013 | Kimura | |
| 2013/0309951 | A1 | 11/2013 | Benvegnu et al. | |

FOREIGN PATENT DOCUMENTS

| | | |
|---|---|---|
| JP | 2003-163191 | 6/2003 |
| JP | 2003-188124 | 7/2003 |
| JP | 2005-32849 | 2/2005 |
| JP | 2007-118106 | 5/2007 |
| JP | 2011-228358 | 11/2011 |
| TW | 200408494 | 6/2004 |
| TW | I220405 | 8/2004 |
| TW | I285579 | 8/2007 |
| TW | I325800 | 6/2010 |

* cited by examiner

METHOD OF PLACING WINDOW IN THIN POLISHING PAD

TECHNICAL FIELD

A polishing pad with a window, a system containing such a polishing pad, and a process for making and using such a polishing pad are described.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the metallic layer remaining between the raised pattern of the insulative layer form vias, plugs, and lines that provide conductive paths between thin film circuits on the substrate. For other applications, such as oxide polishing, the filler layer is planarized until a predetermined thickness is left over the non planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. An abrasive polishing slurry is typically supplied to the surface of the polishing pad.

In general, there is a need to detect when the desired surface planarity or layer thickness has been reached or when an underlying layer has been exposed in order to determine whether to stop polishing. Several techniques have been developed for the in-situ detection of endpoints during the CMP process. For example, an optical monitoring system for in-situ measuring of uniformity of a layer on a substrate during polishing of the layer has been employed. The optical monitoring system can include a light source that directs a light beam toward the substrate during polishing, a detector that measures light reflected from the substrate, and a computer that analyzes a signal from the detector and calculates whether the endpoint has been detected. In some CMP systems, the light beam is directed toward the substrate through a window in the polishing pad.

SUMMARY

In one aspect, a polishing pad includes a polishing layer stack that has a polishing surface, a bottom surface, and an aperture from the polishing surface to the bottom surface. The polishing layer stack includes a polishing layer that has the polishing surface. A fluid-impermeable layer spans the aperture and the polishing pad. A first adhesive layer of a first adhesive material is in contact with and secures the bottom surface of the polishing layer to the fluid-impermeable layer. The first adhesive layer spans the aperture and the polishing pad. The light-transmitting body is positioned in the aperture and has a lower surface in contact with, is secured to the first adhesive layer, and is spaced apart from a side-wall of the aperture by a gap. An adhesive sealant of a different second material is disposed in and laterally fills the gap.

Implementations may include one or more of the following features. The light-transmitting body may be softer than the polishing layer. The adhesive sealant may have about the same hardness as the light-transmitting body. The polishing layer may have a hardness of about 58-65 Shore D and the light-transmitting body may have a hardness of about 45-60 Shore D. A top surface of the light-transmitting body may be recessed relative to the polishing surface.

The gap may completely laterally surround the light-transmitting body. The adhesive sealant may completely vertically fill the gap. The adhesive sealant may extends to contact the first adhesive layer without extending below the light-transmitting body. A second adhesive layer may be positioned on a side of the fluid-impermeable layer opposite the first adhesive layer and in contact with the fluid-impermeable layer. The first adhesive material may be a pressure sensitive adhesive and the second adhesive material may be a cured epoxy or polyurethane. An aperture through the second adhesive layer may be aligned with the light-transmitting body.

A removable liner may cover the second adhesive layer. the polishing layer stack may include the polishing layer and a backing layer. The polishing layer may be a napped polyurethane and the backing layer may be a different material than the polishing layer. Each of the backing layer and the fluid-impermeable may be a polyester. The polishing pad may have a total thickness less than about 3 mm.

In another aspect, a method of making a polishing pad includes forming an aperture through a polishing layer stack from a polishing surface to a bottom surface of the polishing layer to expose a first adhesive layer that is positioned on and contacts the bottom surface of the polishing layer stack and spans the aperture and the polishing pad. The polishing layer stack includes a polishing layer that has the polishing surface. A first adhesive layer secures the bottom surface of the polishing layer stack to a fluid-impermeable layer that layer spans the aperture and the polishing pad. A pre-formed light-transmitting body is positioned in the aperture in the polishing layer such that a lower surface of the light-transmitting body contacts and adheres to the first adhesive layer, an adhesive sealant is dispensed into a gap that separates the light-transmitting body from side-walls of the aperture to laterally fill the gap, and the adhesive sealant is cured.

Implementations may include one or more of the following features. Dispensing the adhesive sealant may completely vertically fill the gap. A portion of a second adhesive layer that is positioned on a side of the fluid-impermeable layer opposite the first adhesive layer and in contact with the fluid-impermeable layer may be removed, wherein the portion is aligned with the transparent body. Forming the aperture may include peeling a portion of the polishing layer stack away from the first adhesive layer while leaving a majority of the first adhesive layer in the aperture on the fluid-impermeable membrane. Forming the aperture may include peeling a disposable cover away from the first adhesive layer while leaving a majority of the first adhesive layer in the aperture on the fluid-impermeable membrane. The disposable cover may be a different material than the polishing layer.

Implementations can include one or more of the following advantages. The risk of leakage of liquid through a window in a polishing pad can be reduced. The risk of delamination of the window can be reduced and/or the size of the window can be increased without increasing the risk of delamination. The risk of warping of the window can be reduced. The window can be soft, but by being recessed from the polishing surface, the risk of the conditioning process scratching the window surface and reducing transparency can be reduced.

The details of one or more implementations are set forth in the accompanying drawings and the description below. Other aspects, features and advantages will be apparent from the description and drawings, and from the claims.

DESCRIPTION OF DRAWINGS

Like reference symbols in the various drawings indicate like elements.

DETAILED DESCRIPTION

Figure 1:
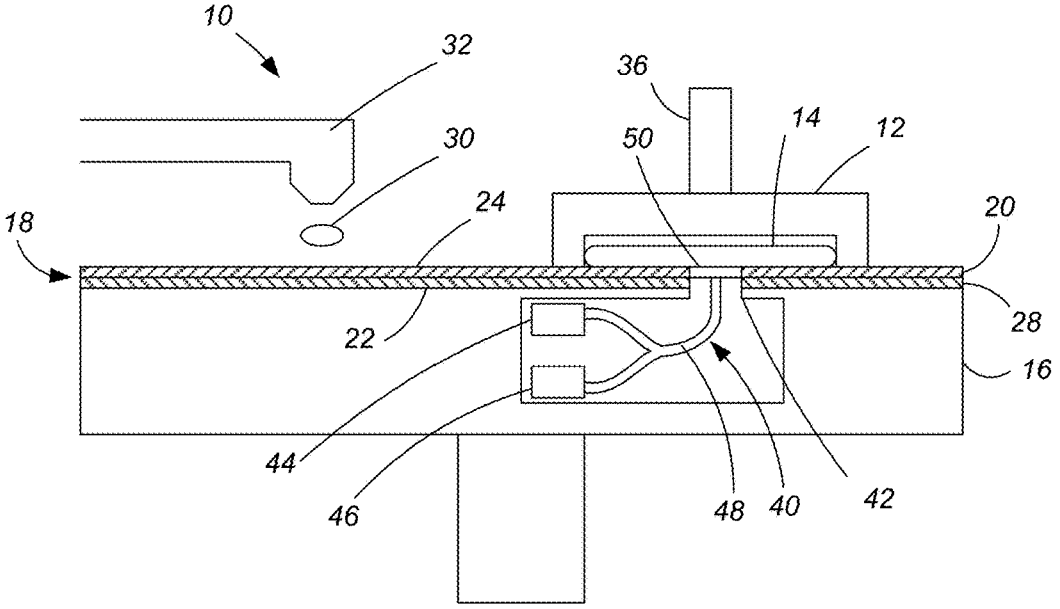
FIG. 1 is a cross-sectional view of a CMP apparatus containing a polishing pad.

As shown in FIG. 1, the CMP apparatus 10 includes a polishing head 12 for holding a semiconductor substrate 14 against a polishing pad 18 on a platen 16. The CMP apparatus may be constructed as described in U.S. Pat. No. 5,738,574.

The substrate can be, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

The polishing pad 18 can include a polishing layer stack 20. The polishing layer stack 20 has a polishing surface 24 to contact the substrate and a bottom surface 22 secured to the platen 16 by an adhesive structure 28.

Figure 3:
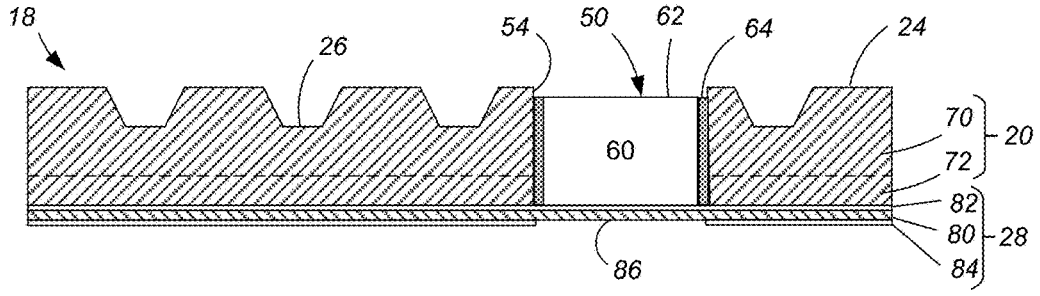
FIG. 3 is a cross-sectional view of a polishing pad of FIG. 2.

Referring to FIG. 3, the polishing layer stack 20 includes one or more layers, including at least a polishing layer 70 that provides the polishing surface 24. The polishing layer 70 is the uppermost layer in the stack 20. The polishing layer is formed of durable material suitable for a chemical mechanical polishing process. The polishing layer 70 can be a napped polymer material. For example, the polishing layer 70 can be a carbon-powder filled polyurethane. The polishing layer 70 can have a hardness of about 58-65, e.g., 62, on the Shore D scale.

The polishing layer 70 can be disposed over a backing layer 72. The polishing layer 70 and the backing layer 72 can be formed of the same or different materials. The backing layer 72 can be a solid sheet or woven fabric. The backing layer 72 can have a lower porosity and lower compressibility than the polishing layer 70. The backing layer 72 can be a polyester, e.g., polyethylene terephthalate (PET).

A polishing pad having such a polishing layer stack is available, for example, under the trade name H7000HN from Fujibo in Tokyo, Japan.

Alternatively, the polishing layer stack 20 can have just a single layer, i.e., the polishing layer 70. Thus, the polishing layer stack can be formed of a single layer of homogenous material.

The adhesive structure 28 can be a double sided adhesive tape. For example, still referring to FIG. 3, the adhesive structure 28 can include a substantially transparent fluid-impermeable layer 80 coated with an upper adhesive layer 82 and a lower adhesive layer 84 respectively. The upper adhesive layer 82 abuts the polishing layer stack 20 and bonds the adhesive structure 28 thereto. In use, the lower adhesive layer 84 abuts the platen 16 and bonds the polishing pad 18 thereto. The upper adhesive layer 82 and the lower adhesive layer can both be a pressure sensitive adhesive material. The upper adhesive layer 82 and the lower adhesive layer 84 can have a thickness of about 0.5 to 5 mil (thousands of an inch). The fluid-impermeable layer 80 can be a polyester, e.g., polyethylene terephthalate (PET), e.g., Mylar™. The fluid-impermeable layer 80 can have a thickness of about 1 to 7 mil. The fluid-impermeable layer 80 can be less compressible than the polishing layer 20.

Figure 2:
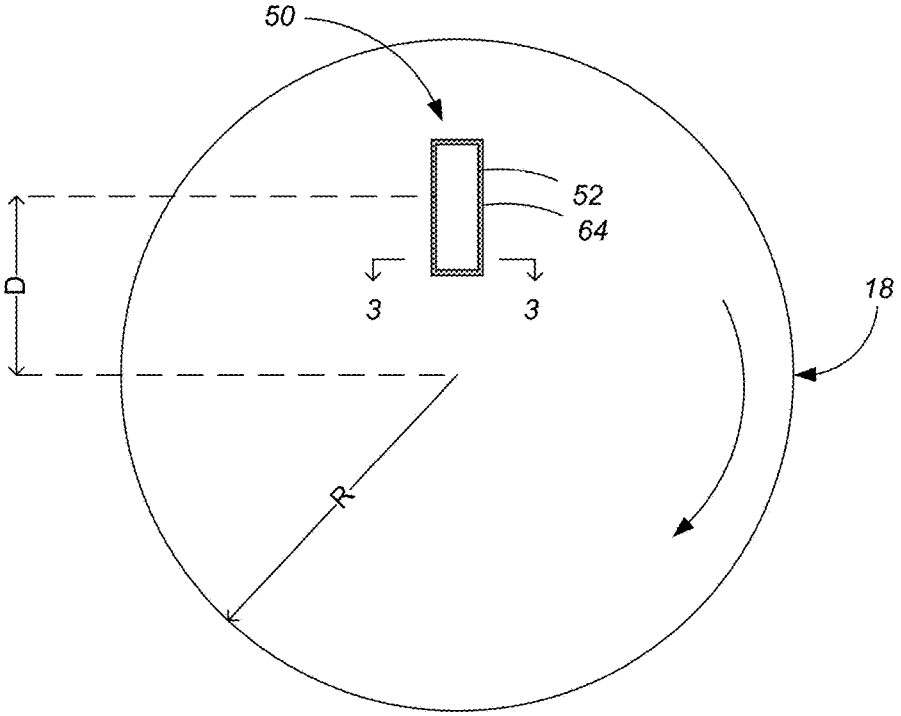
FIG. 2 is a top view of an embodiment of a polishing pad with a window.

Referring to FIG. 2, in some implementations the polishing pad 18 has a radius R of about 15 inches. For example, the polishing pad 18 can have a radius of 15.0 inches (381.00 mm), with a corresponding diameter of about 30 inches, a radius of 15.25 inches (387.35 mm) with a corresponding diameter of 30.5 inches, or a radius of 15.5 inches (393.70 mm) with corresponding diameter of 31 inches. Of course, the window can be implemented in a smaller pad or a larger pad, e.g., a pad with a 42.5 inch diameter.

Referring to FIG. 3, in some implementations, grooves 26 can be formed in the polishing surface 24. The grooves can be arranged in a cross-hatched pattern of perpendicular grooves that divide the polishing surface into rectangular, e.g., square, areas (the view in FIG. 3 shows the cross-section through one set of parallel grooves). Alternatively, the grooves can be concentric circles. The side walls of the grooves 26 can be perpendicular to the polishing surface 24, or the grooves can have sloped side walls. A cross-hatched pattern of perpendicular grooves with sloped side walls can be termed a "waffle" pattern.

Returning to FIG. 1, typically the polishing pad material is wetted with the chemical polishing liquid 30, which can include abrasive particles. For example, the slurry can include KOH (potassium hydroxide) and fumed-silica particles. However, some polishing processes are "abrasive-free." The polishing liquid 30 can be delivered through a port 32 positioned over the polishing pad 18.

The polishing head 12 applies pressure to the substrate 14 against the polishing pad 18 as the platen rotates about its central axis. In addition, the polishing head 12 is usually rotated about its central axis, and translated across the surface of the platen 16 via a drive shaft or translation arm 36. The pressure and relative motion between the substrate and the polishing surface, in conjunction with the polishing solution, result in polishing of the substrate.

An optical aperture 42 is formed in the top surface of the platen 16. An optical monitoring system 40, including a light source 44, such as a laser, and a detector 46, such as a photodetector, can be located below the top surface of the platen 16. For example, the optical monitoring system can be located in a chamber inside the platen 16 that is in optical communication with the optical aperture 42, and can rotate with the platen. The optical aperture 42 can be filled with a transparent solid piece, such as a quartz block, or it can be an empty hole. The light source 44 can employ a wavelength anywhere from the far infrared to ultraviolet, such as red light, although a broadband spectrum, e.g., white light, can also be used, and the detector can be a spectrometer. Light can be carried from the light source 44 to the optical aperture 42, and back from the optical aperture 42 to the detector 46 by optical fibers, e.g., a bifurcated optical fiber 48.

In some implementations, the optical monitoring system 40 and optical aperture 42 are formed as part of a module that fits into a corresponding recess in the platen. Alternatively, the optical monitoring system could be a stationary system located below the platen, and the optical aperture could extend through the platen.

A window 50 is formed in the overlying polishing pad 18 and aligned with the optical aperture 42 in the platen. The window 50 and aperture 42 can be positioned such that they have a view of the substrate 14 held by the polishing head 12 during at least a portion of the platen's rotation, regardless of the translational position of the head 12.

In some implementations, the optical aperture 42 is simply a hole in the platen, and the optical fiber 48 extends through the hole with an end of the optical fiber 48 in close proximity to or contacting the window 50.

The light source 44 projects a light beam through the aperture 42 and the window 50 to impinge the surface of the overlying substrate 14 at least during a time when the window 50 is adjacent the substrate 14. Light reflected from the substrate 14 forms a resultant beam that is detected by the detector 46. The light source 44 and the detector 46 are coupled to an unillustrated computer that receives the measured light intensity from the detector and uses it to determine the polishing endpoint and/or control polishing parameters to improve polishing uniformity.

One problem with placement of a normal large rectangular window (e.g., a 2.25 by 0.75 inch window) into a very thin polishing layer is delamination during polishing. In particular, the lateral frictional force from the substrate during polishing can be greater than the adhesive force of the molding of the window to the sidewall of the pad.

Returning to FIG. 2, the window 50 is thinner along the direction of the frictional force applied by the substrate during polishing (tangential to a radius in the case of a rotating a polishing pad) than in the perpendicular direction (along a radius in the case of a rotating a polishing pad). For example, the window 50 can use an area 1 to 25 mm wide, e.g., about 4 mm wide, and 5 to 75 mm long, e.g., about 9.5 mm long. The window can be centered a distance D of 6 to 12 inches, e.g., about 7.5 inches (190.50 mm) from the center of the polishing pad 18.

The window 50 can have an approximately rectangular shape with its longer dimension substantially parallel to the radius of the polishing pad that passes through the center of the window. In some implementations, the window 50 has a ragged perimeter 52, e.g., the perimeter can be longer than a perimeter of a similarly shaped rectangle. This increases the surface area for contact of the window to the sidewall of the polishing pad, and can thereby improve adhesion of the window to the polishing pad. However, in some implementations, the individual segments of the perimeter 52 of the rectangular window 45 are smooth.

The window 50 includes a solid light-transmitting body 60 that fits in an aperture 54 in the polishing layer stack 20. The light-transmitting body 60 is sufficiently transparent for light from the light source to pass through so that an endpoint signal can be detected with the detector. In some implementations, the light-transmitting body is substantially transparent to visible light, e.g., at least 80% transmittance for wavelengths from 400-700 Angstroms.

The light-transmitting body can be softer than the polishing layer 70. For example, the light-transmitting body 60 can have a hardness of 45-60 Shore D, e.g., about 50 Shore D. The light-transmitting body 60 can be formed of a substantially pure polyurethane. For example the light-transmitting body 60 can be formed of a "water clear" polyurethane.

The light-transmitting body 60 sits on and is bonded to the upper adhesive layer 82. Although the upper adhesive layer 82 is depicted as a continuous layer below the body 60, there may be small areas in which the adhesive has been delaminated. But in general, the adhesive can cover at least a majority of the area in the aperture 54.

The fluid-impermeable layer 80 completely spans the aperture 54. In some implementations, the fluid-impermeable layer 80 spans the entire polishing pad 18. Since the fluid-impermeable layer 80 spans the aperture 54, the risk of leakage of polishing liquid can be reduced.

The light-transmitting body 60 is slightly less thick than the polishing layer stack 20. Thus, the top surface 64 of the light-transmitting body 60 is slightly recessed relative to the polishing surface 24, e.g., by 7.5 to 9.5 mil. By having the light-transmitting body 60 recessed from the polishing surface 24, the risk of the conditioning process scratching the window surface and reducing transparency can be reduced.

The light-transmitting body 60 is slightly narrower than the aperture 54 in the polishing layer stack 20, leaving a small gap on all sides between the light-transmitting body 60 and the polishing layer 20. A sealant 64 is disposed in the gap on all sides of the light-transmitting body 60. The sealant 64 laterally fills (i.e., extends from the side wall of the light-transmitting body 60 to the side wall of the aperture 54) the gap. However, the adhesive sealant 64 does not extend under the light-transmitting body 60, i.e., between the light-transmitting body 60 and the fluid-impermeable layer 80. In addition, the adhesive sealant 64 should not extend over the light-transmitting body 60, i.e., on the top surface 62. However, if some adhesive sealant 62 is on the top surface 62 near the perimeter of the light-transmitting body 60 without covering the center section where the light beam from the light source will pass, this can be acceptable.

In some implementations, the adhesive sealant 64 completely vertically fills the gap between the light-transmitting body 60 and the side wall of the aperture 54.

Figure 9:
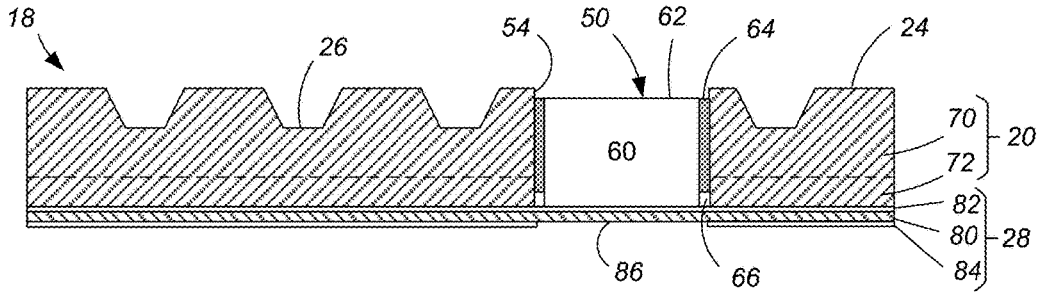
FIG. 9 is a cross-sectional view of another implementation of a polishing pad.

However, in some implementations, the adhesive sealant 64 need not completely vertically fill the gap. For example, as shown in FIG. 9, there can be bubbles or an air gap 66 that remains in the vertical space between the upper adhesive layer 82 and the adhesive sealant 64.

Returning to FIG. 3, the adhesive sealant 62 can be softer than the polishing layer 70. In some implementations, the adhesive sealant 62 is about the same hardness as the light-transmitting body 60, e.g., about 50 Shore D. The adhesive sealant 62 can be a UV or heat curable epoxy. The adhesive sealant 62 can be a different adhesive material than the adhesive of the upper adhesive layer 82.

In some implementations, the lower adhesive layer 84 is removed in a region 86 below the light-transmitting body 60. If the lower adhesive layer 84 is present, there can be a risk that heat from the light beam generated by the light source 44 will cause the lower adhesive layer 84 to liquidize, which can increase opacity of the window assembly.

Figure 4:
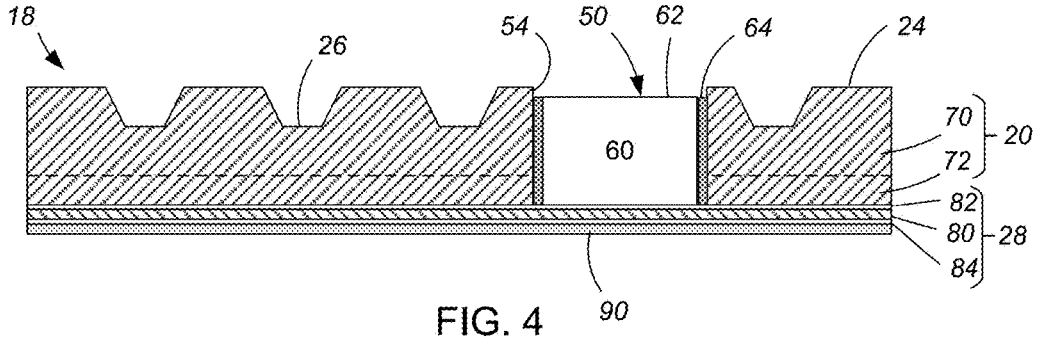
FIGS. 4-8 illustrate a method of forming a polishing pad.

Referring to FIG. 4, before installation on a platen, the polishing pad 18 can also include a liner 90 that spans the adhesive layer 28 on the bottom surface 22 of the polishing pad. The liner can be an incompressible and generally fluid-impermeable layer, for example, a polyester film, e.g., polyethylene terephthalate (PET), e.g., Mylar™. In use, the liner is manually peeled from the polishing pad, and the polishing layer 20 is applied to the platen with the pressure sensitive adhesive 28. In some implementations, the liner 90 spans the window 50, but in some other implementations, the liner does not span the window 40 and is removed in and immediately around the region of the window 50.

The polishing pad 18 is very thin, e.g., less than 3 mm, e.g., less than 1 mm, thick. For example, the total thickness of the polishing layer stack 20, adhesive structure 28 and liner 90 can be about 0.9 mm. The polishing layer 20 can be about 0.8 mm thick, with the adhesive 28 and the liner 90 providing the remaining 0.1 mm. The grooves 26 can be about half the depth of the polishing pad, e.g., roughly 0.5 mm.

Since the light-transmitting body 60 is held within the polishing pad 18 both by the upper adhesive layer 82 (bonding the body 60 to the fluid-impermeable layer 80) and the adhesive sealant 64 (bonding the body 60 to the side wall of the polishing layer 20), the body 60 can be securely attached. Thus, even though the polishing pad is thin, the risk of delamination of the window can be reduced and/or the size of the window can be increased without increasing the risk of delamination.

Figure 5:
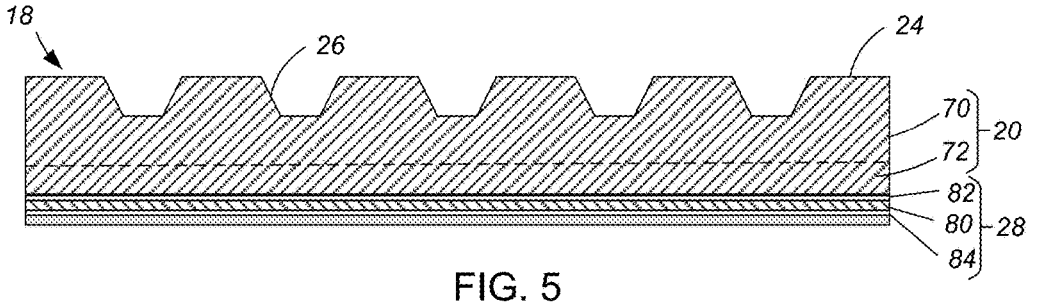
Figure 6:
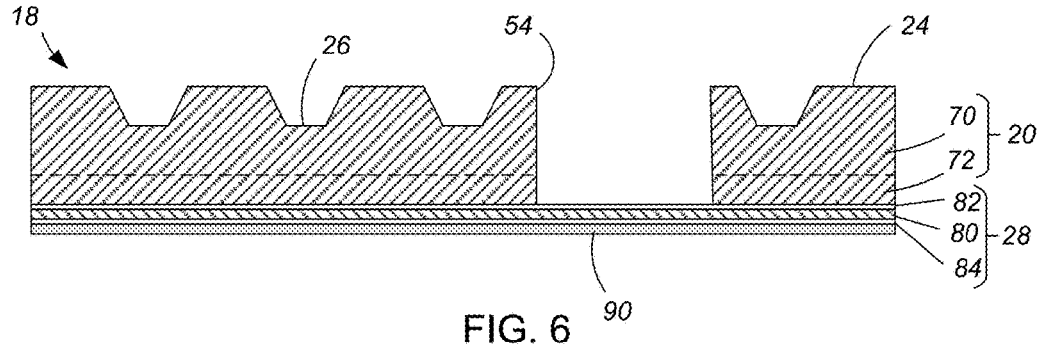

To manufacture the polishing pad, initially the polishing layer stack 20 is formed and the bottom surface of the polishing layer 20 is covered with the adhesive structure 28 and the liner 90, as shown by FIG. 5. Grooves 26 can be formed in the polishing layer 20 as part of a pad molding process, or cut into the polishing layer stack 20 after the polishing layer stack 20 is formed. The grooves can be formed before or after the adhesive structure 28 (and liner) is attached to the polishing layer stack 20.

An aperture 54 is formed through the entire polishing layer stack 20, but not into the fluid-impermeable layer 80. For example, after the multi-layer adhesive structure 28 is attached to the polishing layer stack 20, a precision cut can be made into the polishing layer stack 20 in the shape of the aperture 54. Then the cut-out portion of the polishing layer stack 20 can be peeled away from the fluid-impermeable layer 80, leaving the aperture 54 and exposing at least a portion of the upper adhesive layer 82. Ideally, when the cut-out portion is peeled away, the upper adhesive layer 82 remains attached to the fluid-impermeable layer 80 and does not peel away with the cut-out portion. So the aperture 54 does not extend into the upper adhesive layer 82. However, if some small patches of the upper adhesive layer 82 peel away, this can still be acceptable.

Figure 7:
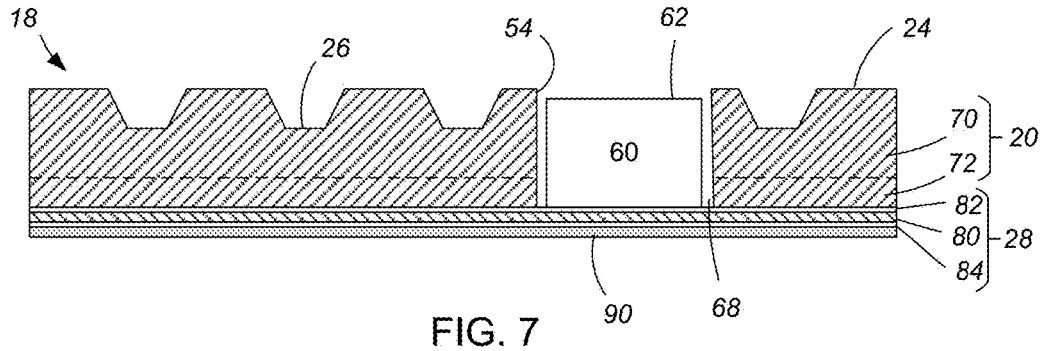

Referring to FIG. 7, a solid light-transmitting body 60 is positioned in the aperture 54 in contact with the upper adhesive layer 82. The solid light-transmitting body 60 is pre-formed, i.e., fabricated as a solid body before being placed into the aperture 54. A potential advantage of using a preformed light-transmitting body, as opposed to curing a liquid polymer in place in the aperture, is that the resulting window and surrounding region of polishing pad can be less subject to warping or distortion.

After the light-transmitting body 60 is positioned, a roller can be pressed and rolled across the top surface 62 of the body 60, from one end to the other, the press the body 60 uniformly against the upper adhesive layer 82. This can also squeeze out any air bubbles between the light-transmitting body 60 and the upper adhesive layer 82.

Figure 8:
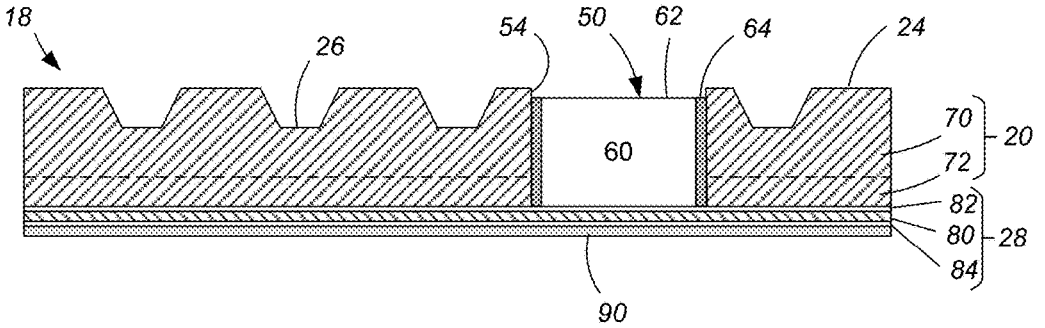

The light-transmitting body 60 is positioned in the aperture 54 such that it is separated by a gap 68 from the side-walls of the aperture 54. Referring to FIG. 8, a liquid sealant 64 is then dispensed into the gap 68. The sealant 64 can be dispensed with a syringe or pipette. By selecting a syringe or pipette with a sufficiently narrow tube, the tube can fit into the gap 68 so that the liquid sealant is dispensed from the bottom of the gap, and completely vertically fills the gap 68.

As shown in FIG. 2, the sealant 64 can completely surround the light-transmitting body 60. The sealant 64 is then cured, e.g., with heat or UV radiation.

The combination of the light-transmitting body 60, and a portion of the light-transmitting adhesive structure 28 below the light-transmitting body 60, thus provide the window 50 through the polishing pad.

If the grooves 24 intersect the aperture 54, then when the liquid sealant 64 is dispensed into the aperture 54, a portion of the liquid sealant can flow along the grooves 24. Thus, some of the sealant 64 can extend past the edge of the aperture 54 to form projections into the grooves. When cured, these projections can further increase the bonding of the light-transmitting body 60 to the polishing pad.

As noted above, a portion 86 of the lower adhesive layer 84 can be removed in the region below the light-transmitting body 60, while leaving the lower adhesive layer 84 over a remainder of the bottom surface 22 of the polishing pad 18 (see FIG. 3). The portion 86 can be removed before the liner 90 is attached. Alternatively, the portion 86 can be removed after the liner 90 is attached. For example, in some implementations, the liner 90 can be attached, and then a portion of the liner 90 and the lower adhesive layer 84 are cut away and removed together. As another example, in some implementations, a region of the liner 90 around the window can be peeled back, the portion 86 of the lower adhesive layer 84 removed, and then the portion of the liner 90 placed back in contact with the lower adhesive layer 84.

The scoring to define the cut-out portion of the polishing layer stack 20 can be performed by a first manufacturer, and the pad shipped with such scoring, and then the cut-out portion of the polishing layer stack 20 removed and the light-transmitting body 60 installed by another manufacturer or the final user. Alternatively, the first manufacturer can remove the cut-out portion of the polishing layer stack 20 and install a disposable cover in the aperture, and then the disposable cover can removed and the light-transmitting body 60 installed by another manufacturer or the final user. An advantage of such approaches is that the upper adhesive layer 82 can be protected from contamination when the pad is being shipped from one manufacturer to another. The disposable cover can be a different material, e.g., a lower cost material, than the polishing layer.

While certain embodiments have been described, it will be understood that various modifications may be made. For example, although a window with a rectangular perimeter is described, the window could be other shapes, such as an oval. Accordingly, other embodiments are within the scope of the following claims.

What is claimed is:

1. A method of making a polishing pad, comprising:

forming an aperture through a polishing layer stack from a polishing surface to a bottom surface of the polishing layer stack to expose a first adhesive layer that is positioned on and contacts the bottom surface of the polishing layer stack and spans the aperture and the polishing pad, the polishing layer stack including a polishing layer having the polishing surface, wherein the first adhesive layer secures the bottom surface of the polishing layer stack to a fluid-impermeable layer that layer spans the aperture and the polishing pad, wherein forming the aperture comprises peeling a disposable cover away from the first adhesive layer while leaving a majority of the first adhesive layer in the aperture on the fluid-impermeable layer, wherein the disposable cover is a different material than the polishing layer;

positioning a pre-formed light-transmitting body in the aperture in the polishing layer stack such that a lower surface of the light-transmitting body contacts and adheres to the first adhesive layer;

dispensing an adhesive sealant into a gap that separates the light-transmitting body from side-walls of the aperture to laterally fill the gap; and curing the adhesive sealant.

* * * * *